United States Patent [19]

Brown et al.

[11] Patent Number: 4,497,343

[45] Date of Patent: Feb. 5, 1985

[54] DISCONNECT ARRANGEMENT FOR BEVERAGE DISPENSER VALVES

[75] Inventors: Wade R. Brown, St. Charles; Henry Wasserstrom, Chicago, both of Ill.

[73] Assignee: The Coca-Cola Company, Atlanta, Ga.

[21] Appl. No.: 343,559

[22] Filed: Jan. 28, 1982

[51] Int. Cl.[3] ..... F17D 1/08

[52] U.S. Cl. ..... 137/614.06; 222/129.1; 251/149.9; 251/89.5

[58] Field of Search ..... 222/129.1, 145; 137/614.05, 614.06; 251/149.9, 89.5

[56] References Cited

U.S. PATENT DOCUMENTS

| | | | |
|---|---|---|---|
| 584,144 | 6/1897 | Gold . | |
| 1,396,659 | 11/1921 | Otis . | |
| 1,428,933 | 9/1922 | Bean, Jr. . | |
| 2,352,434 | 6/1944 | Hoagland . | |
| 2,773,706 | 12/1956 | Leavell . | |
| 3,159,180 | 12/1964 | Courtot et al. . | |
| 3,540,476 | 11/1970 | Fuerst | 251/149.9 |
| 3,646,965 | 3/1972 | Swartz | 137/251 |
| 3,693,655 | 9/1972 | Frisk | 137/251 |
| 3,800,826 | 4/1974 | McCann | 137/222 |
| 3,902,636 | 9/1975 | Zilk | 222/129.1 |
| 4,029,125 | 6/1977 | Steydle et al. | 137/614.06 |
| 4,069,842 | 1/1978 | Steydle et al. | 137/614.06 |
| 4,103,712 | 8/1978 | Fletcher et al. | 137/285 |
| 4,266,726 | 5/1981 | Brown et al. | 222/129.1 |
| 4,351,327 | 9/1982 | Rinne et al. | 137/614.06 |

FOREIGN PATENT DOCUMENTS

| | | | |
|---|---|---|---|
| 177856 | 3/1922 | United Kingdom | 251/149.9 |

*Primary Examiner*—H. Grant Skaggs

[57] ABSTRACT

An improved disconnect arrangement for a beverage dispenser valve assembly prevents disconnection of the valve assembly until the carbonated water and beverage syrup disconnect valves in the mounting block are closed thereby preventing accidental removal of the dispensing valve from the mounting block while the syrup and carbonated water are being supplied to the dispensing valve under pressure. Stops on the retainer assembly prevent the inlet valves from being opened beyond the optimum intake position to assure uniform metering of the syrup and carbonated water by the dispenser valve.

2 Claims, 4 Drawing Figures

DISCONNECT ARRANGEMENT FOR BEVERAGE DISPENSER VALVES

BACKGROUND OF THE INVENTION

1. Field of the Invention

This invention relates generally to valve arrangements for beverage dispensers in which a diluent (e.g., carbonated water) is mixed with a beverage syrup, and more specifically, this invention relates to a quick disconnect arrangement for such beverage dispenser valves which prevents removal of the dispenser valve for cleaning, repair, or replacement while the syrup and diluent is being supplied to the valve under pressure.

2. Description of the Prior Art

Beverage dispensers are in standard use in restaurants and in vending machines to mix and provide soft drink beverages such as colas and the like upon demand. Such soft drinks typically comprise a beverage syrup which includes all of the ingredients and flavorings mixed with a diluent such as carbonated water. Beverage dispensers are preferred over premixed bottled or canned beverages in restaurants and in some vending machines because of the greatly reduced storage requirements for unmixed syrup as opposed to the finished canned or bottled beverage.

However, because such beverage dispenser valves are electromechanical devices usually operated by solenoids such as the fast flow valve arrangement illustrated in U.S. Pat. No. 4,266,726—Brown, et al., and because the beverage syrup contains numerous ingredients including a high concentration of sugar, it is often necessary to remove the valve arrangement for cleaning and/or repair.

Further, since the carbonated water and the beverage syrup are supplied to the dispensing valve under pressure, it is desirable to provide a disconnect arrangement which permits easy, rapid removal of the dispensing valve but which assures that the dispensing valve cannot be removed while the carbonated water and beverage syrup are being supplied to the dispensing valve under pressure. Very often in restaurants and other fast food establishments, multiple valve arrangements for different beverages are being supplied by the same source of carbonated water. Thus, it is desirable to provide a disconnect arrangement which does not require a shutdown of the entire system to permit removal of a single valve arrangement.

SUMMARY OF THE INVENTION

The present invention comprises an improved disconnect arrangement for a beverage dispenser valve assembly mounted on a mounting block. A carbonated water passage and a beverage syrup passage are provided through the mounting block, and a source of carbonated water and beverage syrup communicates respectively with each passage. Disconnect valve means are provided for being opened to allow the flow of carbonated water and beverage syrup through the passages and for being closed to prevent the flow of carbonated water and beverage syrup through the passages.

Retaining means are provided for locking the beverage dispenser valve assembly to the mounting block when the retainer means is moved to a locked position. The retainer means may also be moved to an unlocked position to unlock the beverage dispenser valve assembly from the mounting block. Locking means are provided in association with the disconnect valve means for engaging the retaining means when the valve means is open so that the retaining means is retained in a locked position thereby preventing the dispenser valve assembly from being removed while the vales are open. The locking means disengage the retaining means when the disconnect valve means is closed so that the retaining means may be moved to an unlocked position to allow removal of the beverage dispenser valve assembly for cleaning and repair.

The disconnect valve means, when closed, terminates the supply of beverage syrup and carbonated water to the dispenser valve arrangement but the syrup and carbonated water remain under pressure without a shutdown of the system so that the beverage syrup and carbonated water may be supplied to other similar valve arrangements in the system to assure there is no interruption in service.

Further, so that that the disconnect valve means is opened to an optimum position to assure proper metering of the syrup and carbonated water during beverage dispensing, the retainer means has stop means positioned thereon for engaging and stopping the valve means when the valve means are opened to the optimum flow position. This assures that the valves are not partially opened or opened beyond the optimum position thereby restricting the flow of either the beverage syrup or the carbonated water.

These and other objects, advantages and features of the this invention will hereinafter appear, and for the purposes of illustration, but not for limitation, an exemplary embodiment of the subject invention is shown in the accompanying drawings.

DETAILED DESCRIPTION OF THE PREFERRED EMBODIMENT

Figure 1:
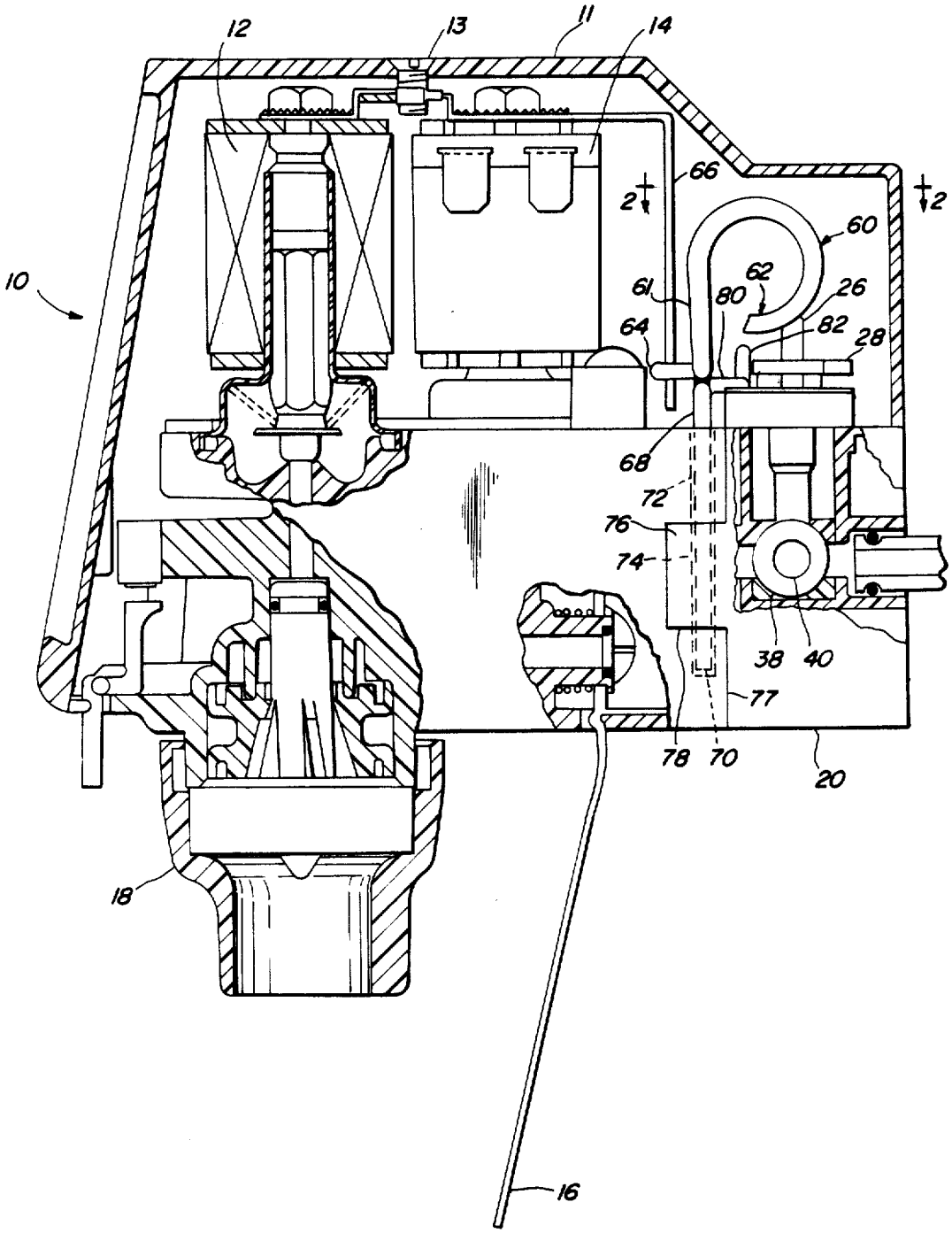
FIG. 1 is a side plan partially cross-section view of a beverage dispensing valve and an improved disconnect assembly in accordance with the present invention.

With reference to FIG. 1, a beverage dispenser valve assembly 10 comprises electrically actuated solenoid valves 12 and 14 which are actuated when a beverage glass or cup is pressed against actuating handle 16 so that a mixture of carbonated water and beverage syrup is dispensed through nozzle 18. A cover 11 held in position by screw 13 covers the internal portions of valve assembly 10. Beverage dispenser valve arrangement 10, illustrated in FIG. 1, is substantially the same as that illustrated and described in U.S. Pat. No. 4,266,726—Brown, et al. It is of a general type wherein carbonated water is mixed with a beverage syrup to produce a beverage upon demand. However, the exact structure of the beverage valve arrangement 10 is not important to the improvement of the present invention which may be utilized in connection with a variety of different types of beverage dispensing valves of this general type.

More particulately, the present invention resides in the improved disconnect assembly which permits beverage valve assembly 10 to be removed from mounting block 20. With references to FIGS. 2, 3, and 4, mounting block 20 comprises a carbonated water disconnect valve 22 and a beverage syrup disconnect valve 24. Disconnect valve 22 has substantially the same structure as disconnect valve 24. A valve actuator 25 comprises an upwardly extending flange 26 mounted on a horizontal member 28. Flange 26 may be easily gripped between two fingers to rotate valve 22. An elongated valve stem 30 is connected to member 28 and extends downwardly into a cylindrical opening 32 in mounting block 20. The upper end of cylindrical opening 32 is sealed by an O-ring 34 positioned in a groove 36 formed in an enlarged portion 37 of valve stem 30. The lower end of valve stem 30 is connected to a ball valve 38 which has a cylindrical passageway 40 through the center thereof. Ball valve 38 seats against conical washers 42 and 44 to assure a moisture tight seal around ball valve 38. Mounting block 20 also comprises a hollow cylindrical extension 46 which forms a hollow passage 48. Extension 46 is inserted into an inlet receptacle 50 of beverage dispensing valve assembly 10 so that passage 48 communicates with the carbonated water inlet 52 in receptacle 50. A similar extension 47 extends into another inlet receptacle 51 for beverage syrup.

Figure 4:
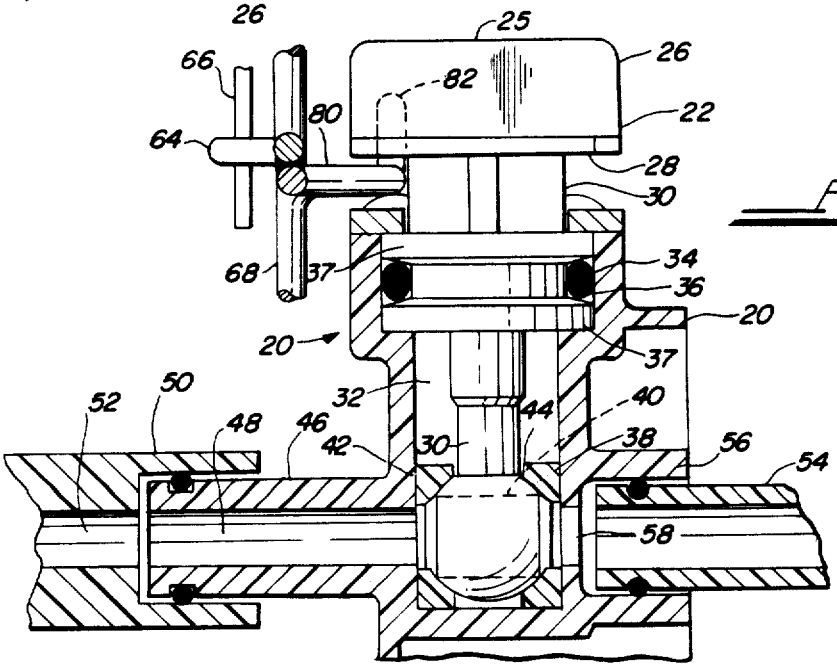
FIG. 4 is a side partially fragmentary cross-sectional view of the disconnect block and a disconnect valve of the present invention taken substantially along line 4—4 in FIG. 2.

A hollow tube 54 is connected to a source of carbonated water (not shown) and inserted into a cylindrical recess 56 in mounting block 20. The end wall of recess 56 has an opening 58 that communicates with ball valve 38. Thus, as illustrated in FIG. 4, a passage for carbonated water is formed through mounting block 20 when disconnect valve 22 is in the position illustrated in FIG. 4. A similar recess 57 communicates with valve 24 to provide a beverage syrup passage through block 20. However, when ball valve 38 is in the position illustrated in FIG. 1, i.e., when actuators 25 are in the position illustrated in FIG. 2, the ball valves are in a closed position with the passages 40 in ball valves 38 being turned perpendicular to the carbonated water and beverage syrup passages through the mounting block 20.

Beverage dispensing valve assembly 10 is normally held in locked engagement with mounting block 20 by slide retainer assembly 60. Retainer assembly 60 is formed from bent sections of wire and comprises a first section 61 bent to form annular portions 62 that can be easily grasped by the fingers. A central extention 64 is bent in section 61 to engage a vertically downward extending stop member 66 mounted to the top of solenoid valves 12 and 14. A second section 68 of retainer assembly 60 is welded to the base of first section 61 and is essentially U-shaped having two downwardly extending legs 70 that extend through openings 72 in the wall of beverage dispensing valve assembly 10 and also through openings 74 in protrusion 76 extending from the front edge 77 of mounting block 20. Protrusion 76 mates with a similarly shaped recess 78 in the rear edge of the side wall of dispensing valve assembly 10. Second section 68 of retainer assembly 60 is also bent to form a horizontally extending portion 80 that extends outwardly towards disconnect valves 22 and 24. Second section 68 of retainer assembly 60 also has a vertically extending portion 82 at about the center thereof that extends upwardly between valves 22 and 24.

Operation of the present invention is best illustrated with reference to FIGS. 1, 2, and 3. In FIG. 1, beverage dispensing valve arrangement 10 is shown in a fully locked position with mounting block 20. Slide retainer assembly 60 is in locking engagement with protrusion 76 of mounting block 20 with legs 70 extending through the opening 74 in protrusion 76.

Figure 3:
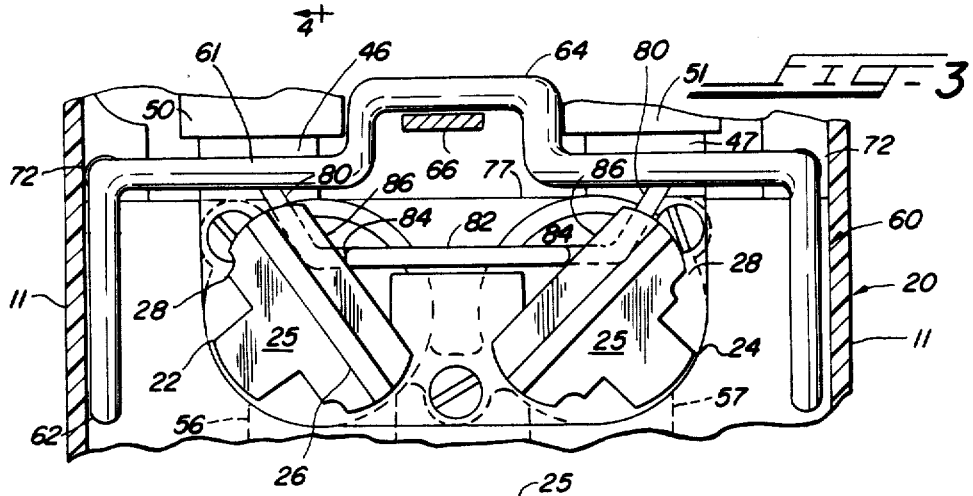
FIG. 3 is the same view as FIG. 2 except the disconnect valves are shown in the open position.

With reference to FIG. 3, the actuator 25 of valves 22 and 24 are shown in the open position so that the carbonated water and beverage syrup is being supplied to the inlets of dispensing valve assembly 10. In the position as illustrated in FIG. 3, it can be seen that the horizontal flange 28 of the actuator 25 of valves 22 and 24 extend over the top of horizontally extending portion 80 of the second section 68 of retainer assembly 60. In this position, it is impossible for retainer assembly 60 to be moved upwardly so that the legs 70 will disengage the opening 74 and protrusion 76 of mounting block 20.

However, if it is necessary to remove the dispensing valve assembly 10 for some reason such as to clean it or to repair it, cover 11 is first removed by removing screw 13 permitting access to actuators 25 of valves 22 and 24 and the annular portions 62 of retainer assembly 60.

Figure 2:
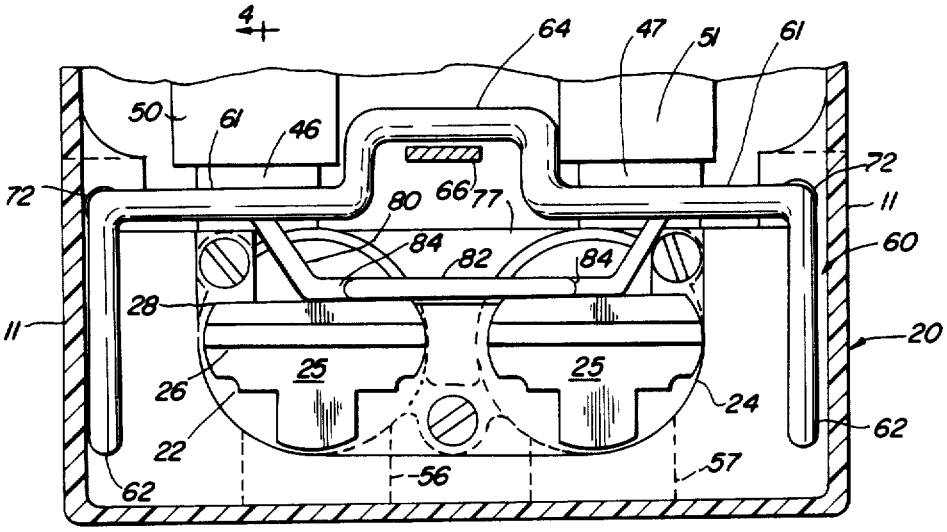
FIG. 2 is a top cross-sectional partially fragmentary view taken substantially along line 2—2 in FIG. 1.

To remove the beverage dispensing valve assembly, actuators 25 of valves 22 and 24 must first be rotated to the position illustrated in FIG. 2 thereby rotating ball valves 38 to the position illustrated in FIG. 1 so that the carbonated water and beverage syrup passages through mounting block 20 are closed. As may be seen, until those valves are closed, it is impossible to move the retainer 60 because the horizontal member 28 engages portion 80 of retainer assembly 60.

Once the valve actuators 25 are in the position illustrated in FIG. 2, retainer assembly 60 may be gripped and pulled upwardly until legs 70 disengage the opening 74 in protrusion 76. Central extension 64 of retainer 60 slides along stop member 66 so that retainer 60 slides vertically but cannot be pulled far enough for legs 70 to disengage the opening 72 in the side wall of valve assembly 10.

Once legs 70 disengage the opening 74 in protrusion 76, the dispensing valve assembly 10 may be moved to the left as illustrated in FIG. 1 thereby causing cylindrical extensions 46 and 47 on mounting block 20 to disengage the recesses in inlet receptacles 50 and 51 of dispensing valve assembly 10. Since ball valves 38 are closed, however, there is no loss of beverage syrup or carbonated water when valve assembly 10 is removed.

To replace dispensing valve assembly 10, the steps are reversed. The valve assembly 10 is placed so that the cylindrical extensions 46 and 47 comate and communicate with receptacles 50 and 51 and openings 72 align with openings 74 in protrusions 76. Retainer assembly 60 can then be pushed downwardly so that legs 70 engage openings 74 thereby locking the valve arrangement 10 to the mounting block 20. Actuators 25 of valves 22 and 24 are then rotated to the position illustrated in FIG. 3 thereby opening the valves to resupply carbonated water and beverage syrup to the dispensing valve assembly 10.

Horizontally extending portion 80 forms vertically aligned stops 84 at each end thereof which engage the front edge 86 of horizontal member 28 of the actuators 25 of valves 22 and 24 when they are rotated in the position illustrated in FIG. 3. Vertically extending portion 82 is formed and positioned in such a manner that the stops 84 are in the proper position to cause ball valve 38 to stop so that passage 40 is in alignment with passage 48 and opening 58 in block 20. This assures that the flow of carbonated water and beverage syrup through the passages in block 20 is not restricted. Thus, once the proper syrup to carbonated beverage ratio has been set by appropriate adjustment of dispensing valve assembly 10, the valve arrangement will continue to supply beverage in the proper mixed ratio even after the valve arrangement 10 has been removed and replaced on block 20. If valves 22 or 24 were rotated too far or not far enough, the ball valve would restrict the flow of carbonated water or beverage syrup thereby causing an inaccurate ratio of one to the other resulting in an inferior beverage.

It should be appparent that various alterations, modifications, and changes may be made in the structure of the preferred embodiment illustrated herein without departing from the spirit and scope of the present invention as defined in the appended claims.

We claim:

1. In a beverage dispenser including a valve assembly removably connected to a mounting block, the valve assembly including a carbonated water inlet and a beverage syrup inlet and a dispensing valve for mixing and controlling the flow of beverage syrup and carbonated water dispensed by the beverage dispenser; and improved disconnect arrangement comprising:

said mounting block including means for connecting said mounting block to a source of carbonated water and to a source of beverage syrup;

a carbonated water passage through said mounting block communicating with the carbonated water inlet in the beverage dispenser;

a beverage syrup passage through said mounting block communicating with the beverage syrup inlet in the beverage dispenser;

said mounting block including disconnect valve means for being opened to allow flow of and for being closed to prevent the flow of carbonated water and beverage syrup respectively through said carbonated water passage and said beverage syrup passage;

retainer means for locking said beverage dispenser valve assembly to said mounting block when moved to a locked position and for unlocking said beverage dispenser valve assembly from said mounting block when moved to an unlocked position;

rotary locking means connected to said disconnect valve means for rotating into a first rotary position in locking engagement with said retainer means when said disconnect valve means is open for holding said retainer means in a locked position, and for rotating into a second rotary position wherein said rotary locking means is disengaged from said retainer means when said disconnect valves means is closed so that said retainer means may be moved to its unlocked position so that said valve assembly can be removed from said mounting block; and stop means on said retainer means for engaging said disconnect valve means when said disconnect valve means is opened to an optimum flow position so that said disconnect valve means may be returned to said optimum flow position each time said beverage dispenser valve assembly is removed and then reconnected to said mounting block.

2. In a beverage dispenser including a valve assembly removably connected to a mounting block, the valve assembly including a carbonated water inlet, a beverage syrup inlet, and a dispensing valve for mixing and controlling the flow of beverage syrup and carbonated water dispensed by the beverage dispenser; an improved disconnect arrangement comprising:

said mounting block including means for connecting said mounting block to a source of carbonated water and to a source of beverage syrup;

a carbonated water passage through said mounting block communicating with the carbonated water inlet in the beverage dispenser;

a beverage syrup passage through said mounting block communicating with the beverage syrup inlet in the beverage dispenser;

said mounting block including first disconnect valve means for being opened to allow the flow of carbonated water through said carbonated water passage in said mounting block and for being closed to prevent the flow of carbonated water through said carbonated water passage;

said mounted block including second disconnect valve means for being opened to allow the flow of beverage syrup through said beverage syrup passage in said mounting block and for being closed to prevent the flow of beverage syrup through said beverage syrup passage;

a protrusion on said mounting block for extending into a comating recess on said valve assembly, said protrusion having an opening therethrough which aligns with an opening through said valve assembly when said protrusion is in said recess;

a sliding retainer moveable in said opening in said valve assembly to slide into and through the opening in said protrusion when said protrusion is in said recess to lock said valve assembly to said mounting block;

first and second separate, rotary locking members, each connected to a respective one of said first and second disconnect valves means, said first and second locking members each having a first rotary position engaging said retainer to prevent said retainer from disengaging the opening in said protrusion when said first and second valve means are opened, and said first and second locking members each having a second rotary position disengaging said retainer when said first and second valve means are closed so that said retainer can be moved to disengage the opening in said protrusion whereby said valve assembly can then be disconnected and removed from said mounting block; and said retainer means having a stop means positioned thereon to stop said first and second rotary locking members when said first and second disconnect valve means are opened to an optimum flow position.

* * * * *